United States Patent [19]

Jackson

[11] Patent Number: 4,583,444

[45] Date of Patent: Apr. 22, 1986

[54] ARMORED VEHICLE WITH ROTATABLE SWING-AWAY TURRET

[75] Inventor: Theodore A. Jackson, Utica, Mich.

[73] Assignee: Ex-Cell-O Corporation, Troy, Mich.

[21] Appl. No.: 558,134

[22] Filed: Dec. 5, 1983

[51] Int. Cl.[4] ..... F41H 5/22; F41H 7/02

[52] U.S. Cl. ..... 89/36.13; 89/36.08; 89/36.14; 89/40.03

[58] Field of Search ..... 89/36.08, 36.13, 36.14, 89/40.03

[56] References Cited

U.S. PATENT DOCUMENTS

| | | | |
|---|---|---|---|
| 1,336,133 | 4/1920 | Christie | 89/36.08 |
| 1,366,550 | 1/1921 | Alden | 89/36.08 |
| 2,933,981 | 4/1960 | Anderson et al. | 89/36.08 X |
| 2,983,197 | 5/1961 | Panhard | 89/36.13 |
| 3,145,620 | 8/1964 | Even | 89/36.08 |
| 3,348,451 | 10/1967 | Vickers | 89/36.13 |
| 3,355,987 | 12/1967 | Kunze | 89/36.08 |
| 3,721,201 | 3/1973 | Boller | 89/36.01 X |
| 3,724,323 | 4/1973 | Selle | 89/36.14 |
| 3,757,635 | 9/1973 | Hickerson et al. | 89/36.08 |
| 4,004,494 | 1/1977 | Mechulam et al. | 89/36.14 |
| 4,144,797 | 3/1979 | Berge et al. | 89/36.13 X |
| 4,158,986 | 6/1979 | Appelblatt et al. | 89/36.08 |

*Primary Examiner*—David H. Brown

*Attorney, Agent, or Firm*—Edward J. Timmer

[57] ABSTRACT

A turret is mounted on an armored vehicle in rotating and pivotal fashion to allow the turret to be pivoted eccentrically from its operative position laterally out of the way without disturbing rotational engagement to expose an access hatch on the vehicle body for maintenance inside the vehicle. Removal of the turret from the vehicle is not required. After maintenance, the turret can be swung back to its original operative position for rotation on the vehicle. An operator's cage is attached to the turret and is specially configured such that the turret can be swung out of the way a sufficient amount without the cage hitting interior vehicle components.

9 Claims, 12 Drawing Figures

ARMORED VEHICLE WITH ROTATABLE SWING-AWAY TURRET

FIELD OF THE INVENTION

The present invention relates to an armored vehicle having a turret which is rotatable during normal use and which can be swung away eccentrically on a pivot from its normal operative position without removal from the vehicle for vehicle maintenance purposes.

BACKGROUND OF THE ART

In the past, maintenance of armored vehicles such as tanks, armored personnel carriers and the like having a rotatable turret thereon required that the turret be removed from the vehicle to obtain access to the vehicle engine compartment through an access hatch on the vehicle body that normally cannot be opened because of interference with the turret. Of course, removal of the turret from the vehicle requires heavy equipment such as a crane of one type or another to lift the turret off the vehicle and is a complex time-consuming procedure, especially under field conditions, where the required equipment for turret removal may not be available. There is thus a need to simplify and facilitate maintenance of turret-carrying armored vehicles.

The Panhard U.S. Pat. No. 2,983,197 issued May 9, 1961 shows a light-weight turret including two machine guns and a grenade launcher.

The Even U.S. Pat. No. 3,145,620 issued Aug. 25, 1964 describes a two-man tank vehicle having a rotatable turret supported on the vehicle body in such a manner as to increase the field of vision of the driver.

The Vickers U.S. Pat. No. 3,348,451 issued Oct. 24, 1967 shows a gun turret with a gun mounting, the major part of which is located outside the turret.

The Selle U.S. Pat. No. 3,724,323 issued Apr. 3, 1973 illustrates a hatch cover for an armored vehicle which pivots in a balanced manner vertically about a pair of pivot bearings into a hatch opening and an armored collar to provide additional visibility and occupant protection.

An observation structure such as for a turret is described in the Mechulam et al. U.S. Pat. No. 4,004,494 issued Jan. 25, 1977 while an armored vehicle with a turret is disclosed in the Appelblatt et al. U.S. Pat. No. 4,158,986 issued Jun. 26, 1979.

A remote-controlled bomb recovery and shield apparatus is disclosed in the Boller U.S. Pat. No. 3,721,201 issued Mar. 30, 1973. The apparatus includes a high strength shell to enclose a bomb and a wire rope covered lid pivotable on a post on the top of the shell to an open position to permit a pick-up device to place the bomb in the shell and pivotable to a closed position over the top of the shell.

SUMMARY OF THE INVENTION

The present invention has as an object to provide an armored vehicle with a turret which is not only rotatably but also pivotably mounted on the vehicle so that it can be swung or pivoted eccentrically from its operative position out of the way to permit opening of an access hatch on the vehicle body for maintenance and then returned to its rotatable position.

The present invention has as another object to provide an armored vehicle with such a swing-away turret which does not have to be removed from the vehicle to expose the access hatch for maintenance access and the pivoting of which does not require disengagement of rotational mounting of the turret.

The present invention has as still another object to provide an armored vehicle with such a swing-away turret which can be pivoted out of the way for maintenance and returned to its normal operation position manually or by light equipment such as a rope, pry bar, winch or pulley, especially under field conditions.

The present invention contemplates an armored vehicle with a swing-away turret which is rotatably mounted to the vehicle and which also is pivotally mounted to the vehicle body by pivotal means so that the turret can be pivoted or swung eccentrically from its operative position to an outboard position to expose a vehicle body access hatch for maintenance and then returned to its operative position for rotation.

In a typical working embodiment of the invention, the armored vehicle includes a turret having a turret body which is mounted on the vehicle by means of an annular turret support member. The turret support member is mounted on the vehicle in a releasable operative position with the turret body rotatable thereon. During maintenance, the operative position of the turret support member can be released to allow pivoting of the support member and turret body thereon relative to the vehicle body about a pivot axis substantially parallel to the rotational axis of the turret body. Preferably, a plurality of releasable connector means are provided between the vehicle body and turret support member. One of the connector means is adapted to function as an eccentric pivot means about which the turret body can be pivoted or swung out of the way to expose the access hatch for opening for vehicle maintenance purposes when the other connector means are released and then returned to its original operative position for connection to the vehicle. Preferably, the connector means comprise a plurality of threaded bolts interconnecting the vehicle body and the annular turret support member with one of the bolts configured to function as a turret pivot when the others are released. The turret body is rotatably mounted on the annular support member by means of bearing means therebetween. As a result, the turret body can be pivoted or swung out of the way without affecting the rotatable mounting between the turret body and support member.

In a particularly preferred embodiment of the invention, an operator's cage means is attached to the turret body for eccentric movement therewith and is specially configured so that the turret can be swung out of the way for maintenance of the vehicle with the cage means remaining inside the vehicle and movable with the turret without hitting the interior vehicle components.

DESCRIPTION OF PREFERRED EMBODIMENTS

Figure 1:
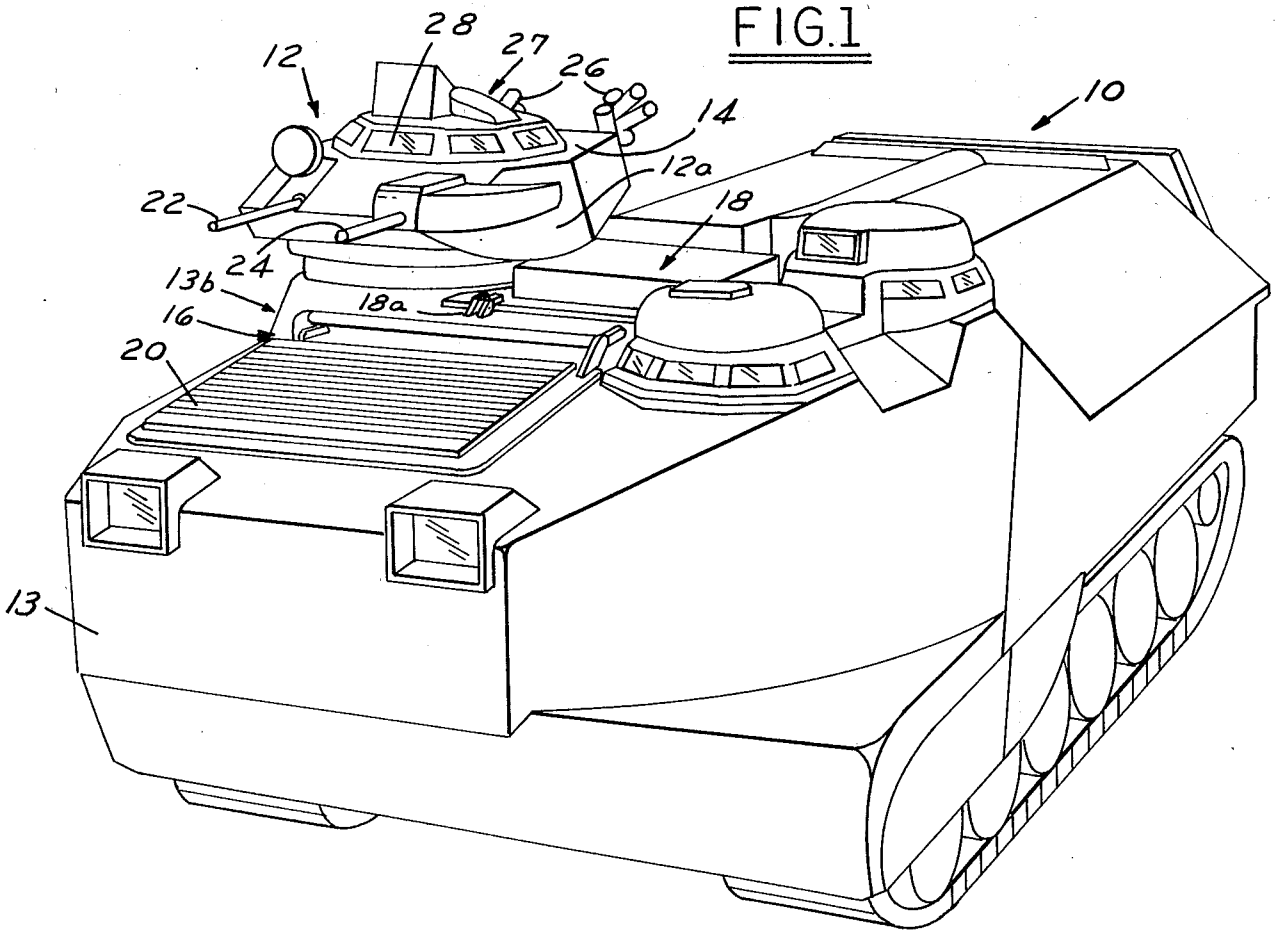
FIG. 1 is a perspective of an armored personnel carrier having a turret mounted thereon in accordance with the invention.
Figure 2:
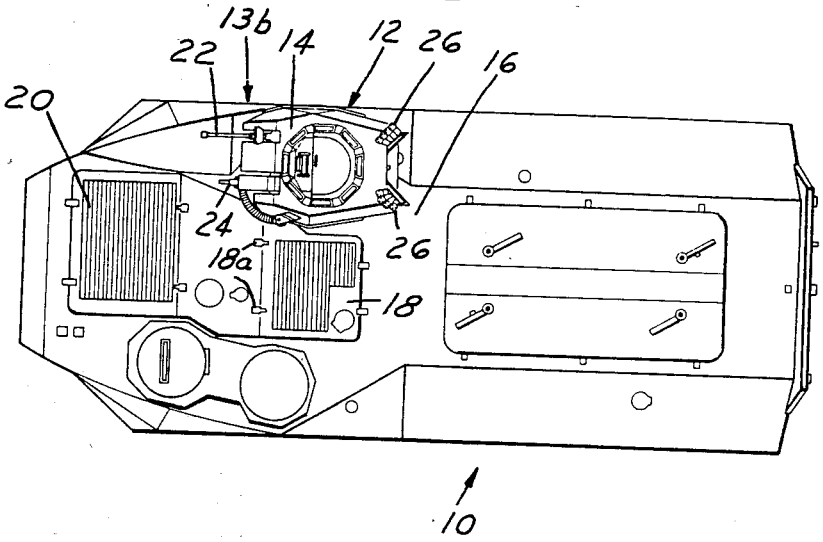
FIG. 2 is a top view of the armored personnel carrier of FIG. 1.

An armored personnel carrier vehicle 10 with a turret 12 mounted in operative position thereon is shown in FIG. 1. The vehicle includes a body 13 having a top surface 16 with an engine exhaust plenum hatch 18 hinged thereon and elevated above top surface 16. As is apparent, the turret 12 includes a portion 12*a* as well as other similar portions which overhang or overly a portion of the hatch 18 during normal mounting and operation on the vehicle and prevent opening of the hatch. The vehicle also includes an engine intake plenum hatch 20 in front of the turret 12 and with which the turret 12 does not interfere.

Figure 3:
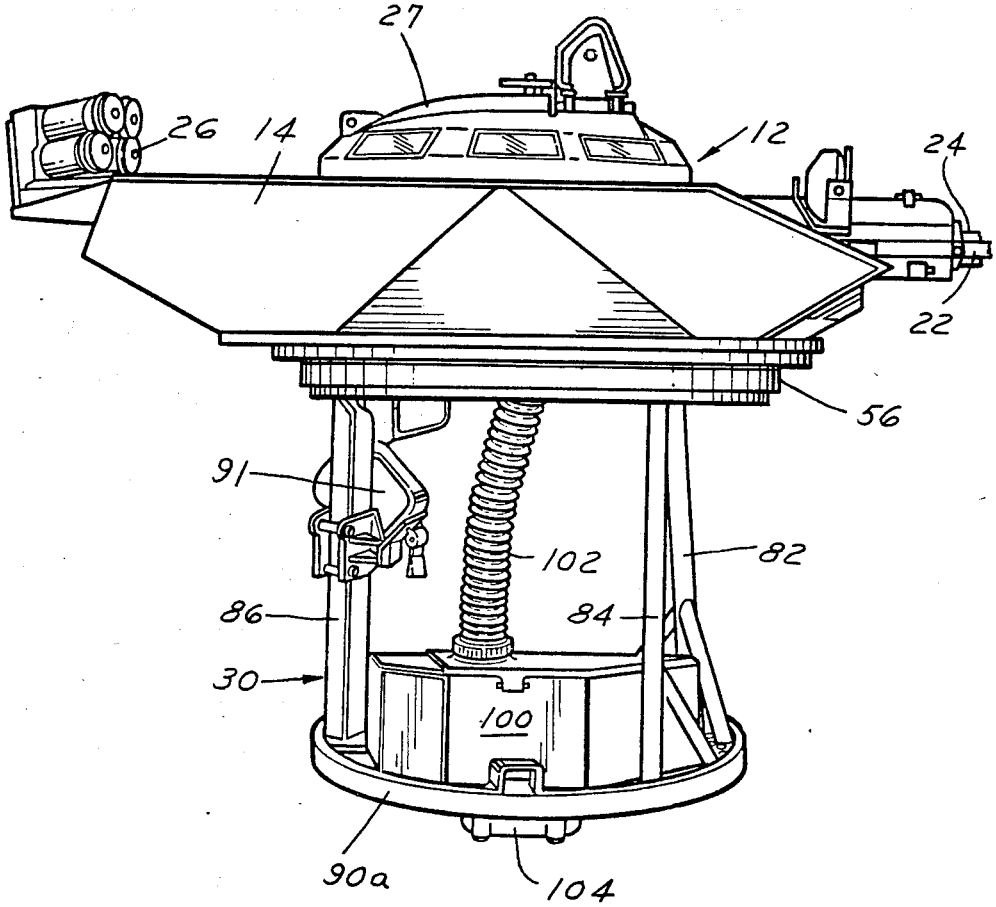
FIG. 3 is an elevation of the turret outside the vehicle with operator's cage attached.

The turret carries a pair of weapons 22 and 24, a grenade launcher 26 and observation dome 27 including a plurality of windows 28. As shown better in FIG. 3, the turret 12 also carries an operator's cage or basket 30 which is attached thereto, as will be more fully explained herebelow, for rotation therewith during usual operation and during pivoting of the turret.

Figure 4:
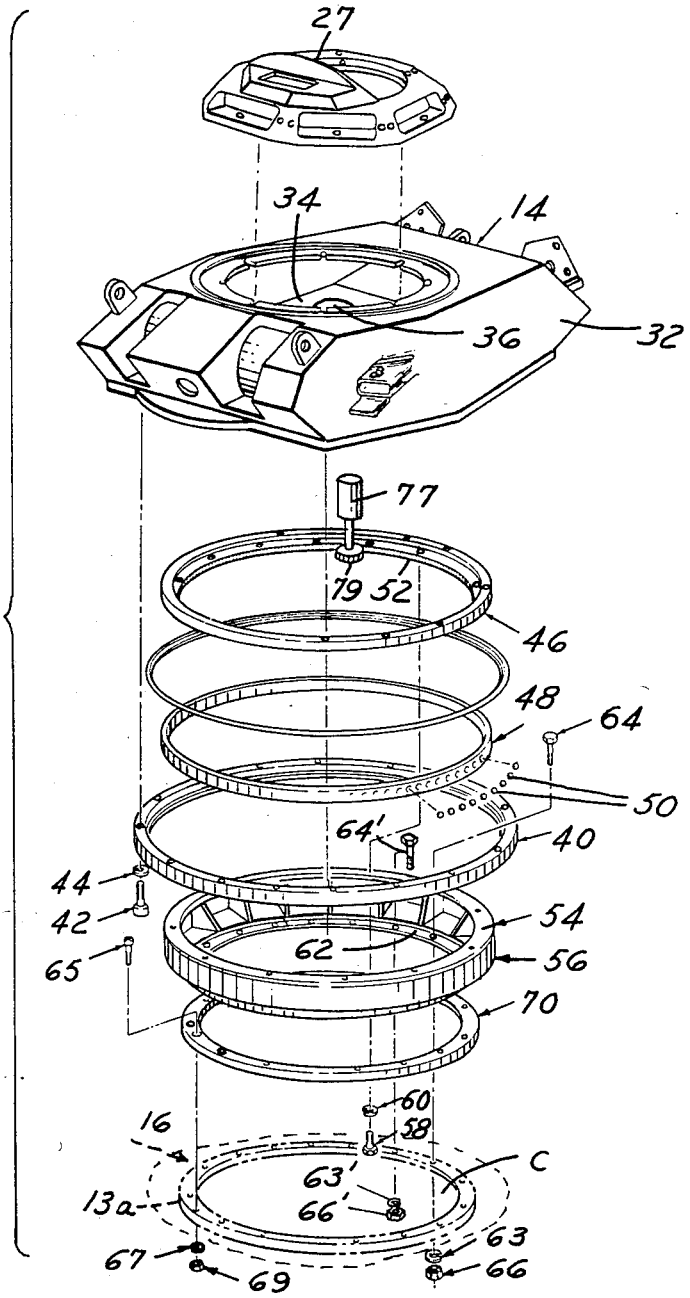
FIG. 4 is an exploded perspective showing the turret mounting components relative to the rim on the top surface of the vehicle.

The turret has an armor body 14 which terminates on the bottom in a floor 34 with an opening 36 therein, FIG. 4. An annular outer race 40 is attached to the turret floor 34 as by a plurality of threaded bolts 42 and lock washers 44. The outer race 40 cooperates with inner race 46 and bearing cage 48 and balls 50 therebetween. Inner race 46 includes an annular ring gear 52 and is attached to upper flange 54 of an annular riser member 56 which functions as turret support means, such as by a plurality of bolts 58 and lock washers 60. The bottom flange 62 of the riser or turret support member 56 is attached by bolts 64 lock washers 63 and nuts 66 to the rim 13*a* of the vehicle body 13 with an annular spacer member 70 therebetween around a circular opening C in the vehicle body 13. Annular spacer member 70 is separately affixed to the rim 13*a* by bolts 65, lock washers 67 and nuts 69, the ends of the bolts 65 being recessed below the top surface of the spacer member 70.

Figure 5:
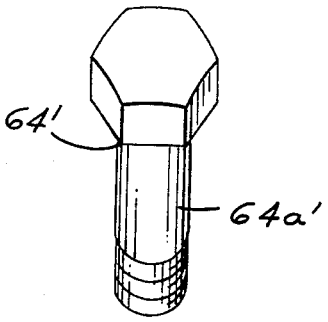
FIG. 5 is an elevation of the pivot bolt and nut.

The turret body 14 is thus independently rotatably mounted in an operative position relative to a vertical rotational axis through circular opening C in the vehicle body by means of outer race 40, inner race 46 and balls 50 between the turret body and the riser or turret support member 56 as shown in FIG. 4. A motor 77 is supported in the turret body 14 and includes a pinion 79 in mesh with the ring gear 40 to rotate the turret body 32. The turret is also releasably mounted on the vehicle body by nuts 66 and bolts 64 used to interconnect the riser member 56 in the operative position on the spacer member 70 and vehicle rim 13*a*. All but one of these bolts 64 are standard ¾ inch diameter threaded bolts with complementary nuts. However, one set of the nuts and bolts differs from the others in that the bolt 64' is provided with a cylindrical shoulder 64*a'* along a major portion of its length, as shown in FIG. 5. The bolt 64', lockwasher 63' and companion nut 66' are located at the rear center of the riser member 56 and turret 12 as shown in FIGS. 12 and 4.

Figure 12:
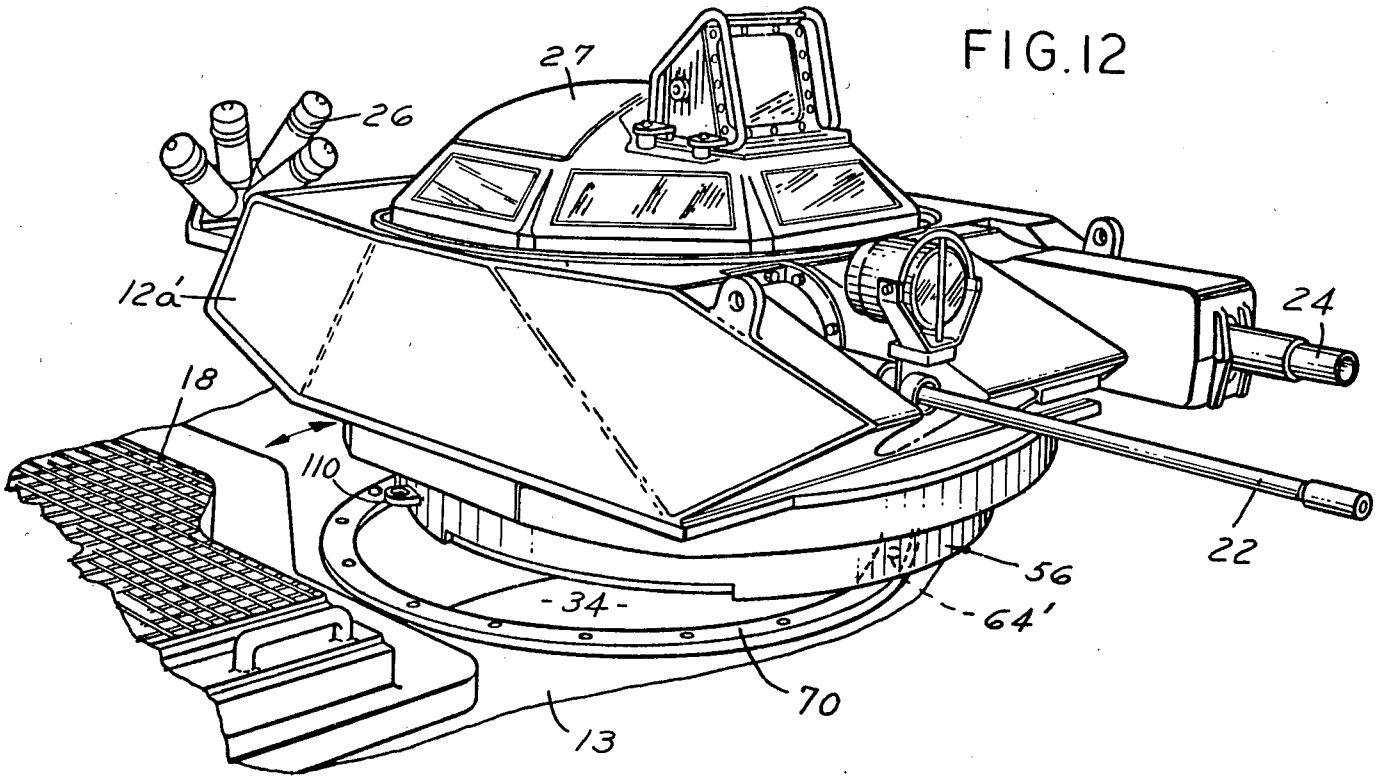
FIG. 12 is a partial perspective showing the turret pivoted as in FIG. 11.

By releasing all the bolts 64 and nuts 66 while leaving bolt 64' and its corresponding nut 66' intact but slightly loosened, the turret can be released from its operative position on the vehicle body and placed in an eccentric pivotal mounting relationship thereon so that the turret can be swung or pivoted eccentrically (relative to the vertical axis through opening C) as shown by the arrow in FIG. 12 about the bolt 64' which acts as a pivot means therefor having a pivot axis substantially parallel to the rotational axis of the turret. In this way, the access hatch 18 on the vehicle body can be exposed for opening for maintenance or other purposes without having to remove the turret from the vehicle. The turret 12 can be simply swung back in the opposite direction overlying the access hatch and releasably attached to the riser member 50 following maintenance, as will be explained herebelow. It is apparent that the horizontal plane of rotation of the turret is spaced above and substantially parallel to its horizontal plane of pivoting.

Figure 6:
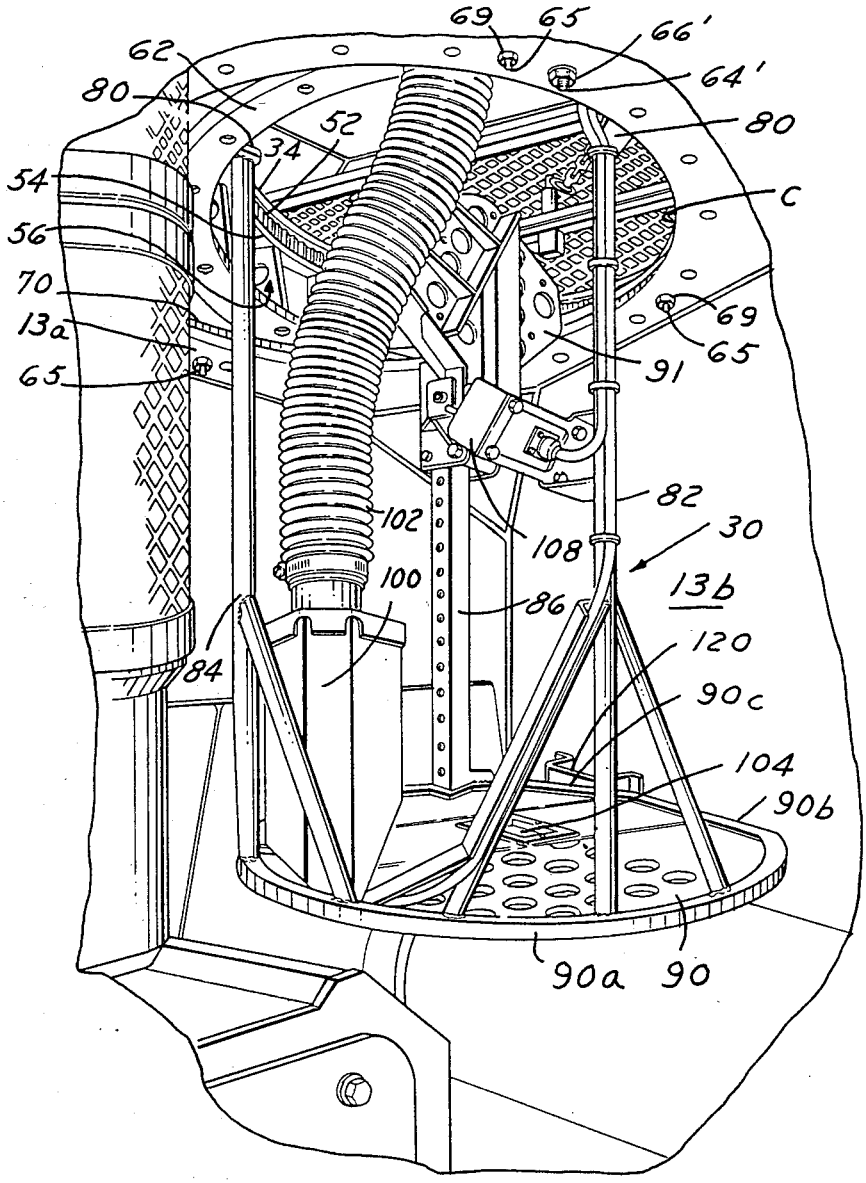
FIG. 6 is a partial perspective from inside the vehicle showing the operator's cage attached to the turret which is in the pivoted position.

As shown in FIG. 6, an operator's cage 30 is carried on the turret 12 and in particular is bolted to the floor 34 by means of flanges 80 extending from support tubes 82, 84 and seat support tube 86. The support tubes 82, 84, 86 are attached as by welding to a floor portion 90 for example of perforated metal plate. The seat 91 is vertically adjustable and is described in co-pending application entitled Adjustable Height Seat Apparatus For Combat Vehicle, Ser. No. 533,474, of common inventor and assignee herewith.

Figure 7:
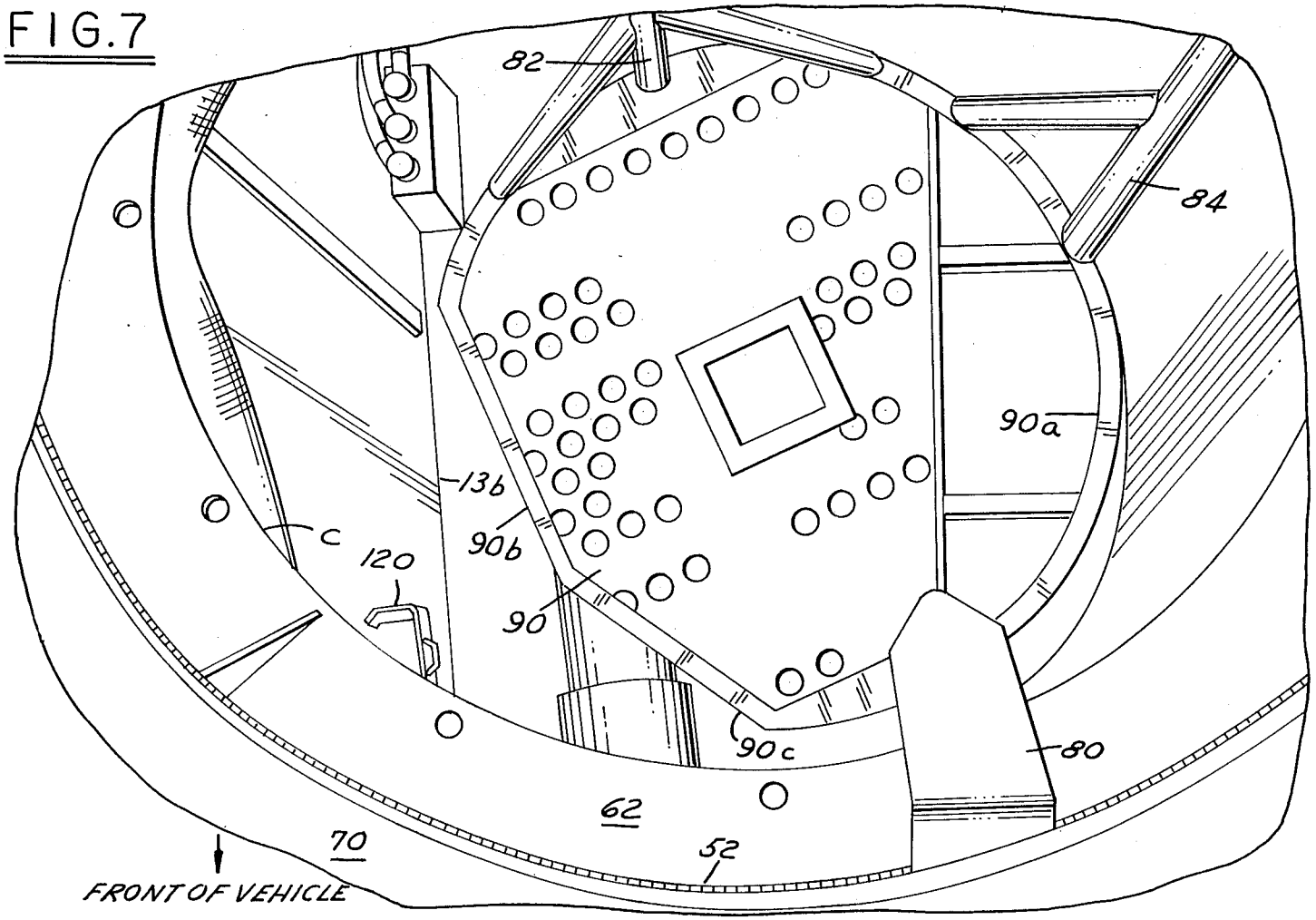
FIG. 7 is a top perspective into the vehicle showing the operator's cage when the turret is rotated to the position of FIG. 9.
Figure 8:
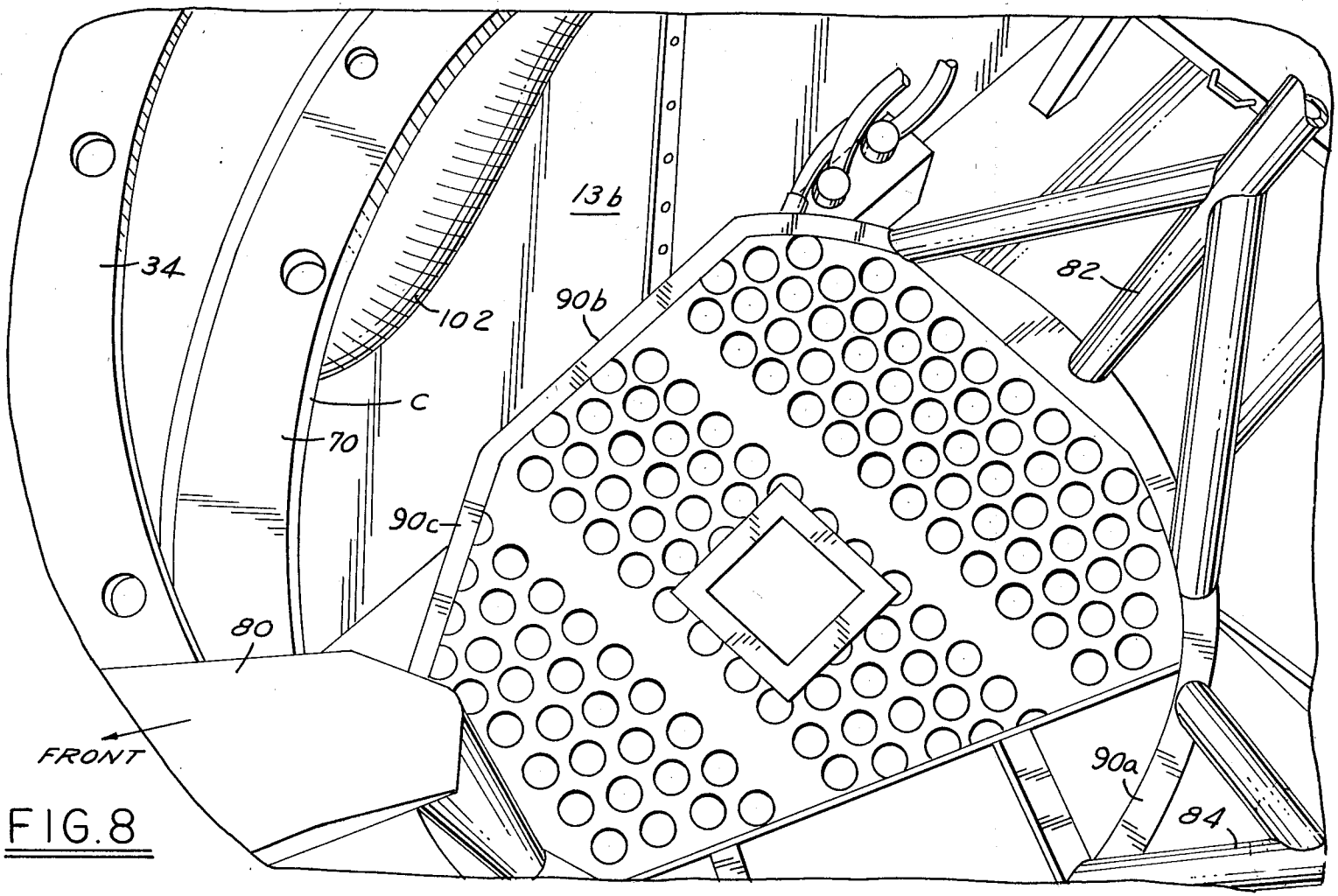
FIG. 8 is a similar view when the turret is pivoted to the position of FIG. 11.

As is apparent from FIGS. 6, 7 and 8, the cage floor 90 is in the form of a truncated circle having circular arc portion 90*a* and truncated straight portions 90*b*, 90*c*. The support tubes 82, 84, 86 are attached such as by welding around the periphery of the circular arc portion 90*a* leaving the truncated portions 90*b*, 90*c* unobstructed for purposes to be explained herebelow.

The cage floor 90 also carries a container 100 for receiving spent cartridges form one of the weapons 22 or 24 via a flexible hose or chute 102. And, a slip ring 104 is releasably mounted on the bottom of the cage floor 90 by bolts for providing electrical connection for electrical turret controls 108 on the cage.

In FIG. 6, the turret body 14 is shown pivoted or swung away from its releasable operative position on rim 13*a* and spacer member 70. For example, bolts 65 and nuts 69 attaching the spacer member to the rim are shown along with bolt 64' and nut 66' which provide the pivot means for the turret body. It is apparent that the riser or turret support member 56 has been pivoted relative to the spacer member.

As seen best in FIG. 12, a pulling eyelet 110 is attached to the riser member 50 and is adapted to receive a hook, chain, rope or the like so that the turret 12 can be pivoted or swung out of the way about bolt 64' simply by pulling thereon with light equipment such as a winch or pulley. Typically, the turret will be initially pivoted by use of a pry bar to move it out of the way to allow opening of the exhaust plenum hatch 18 and then the turret will be pulled back to its original operative position by a rope attached to eyelet 110.

Figure 9:
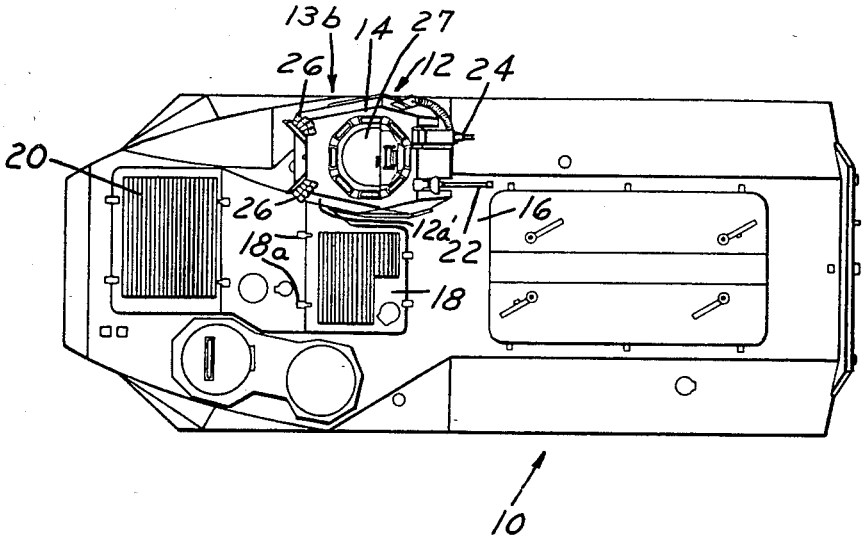
FIG. 9 is a top elevation showing the turret rotated so that the weapons face the rear of the vehicle.
Figure 11:
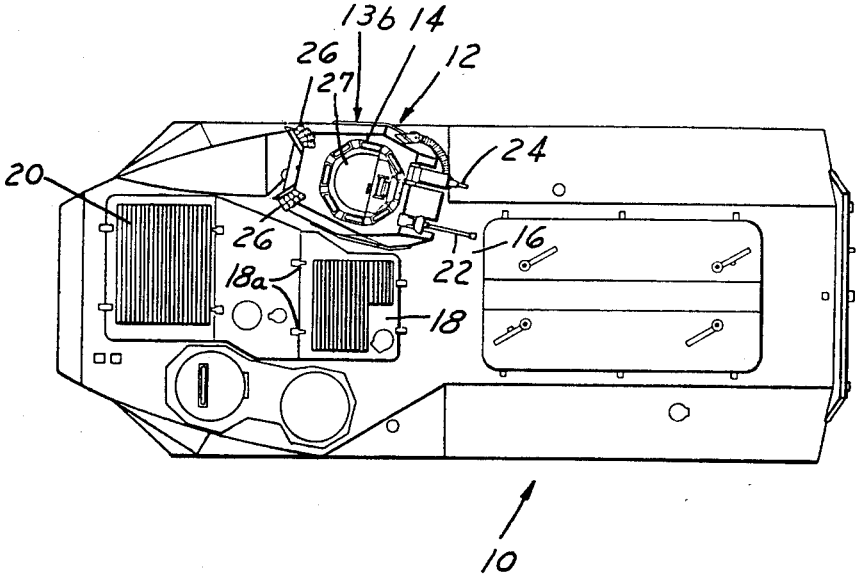
FIG. 11 is a top elevation of the vehicle showing the turret pivoted outboard to allow opening of the exhaust plenum hatch.
Figure 10:
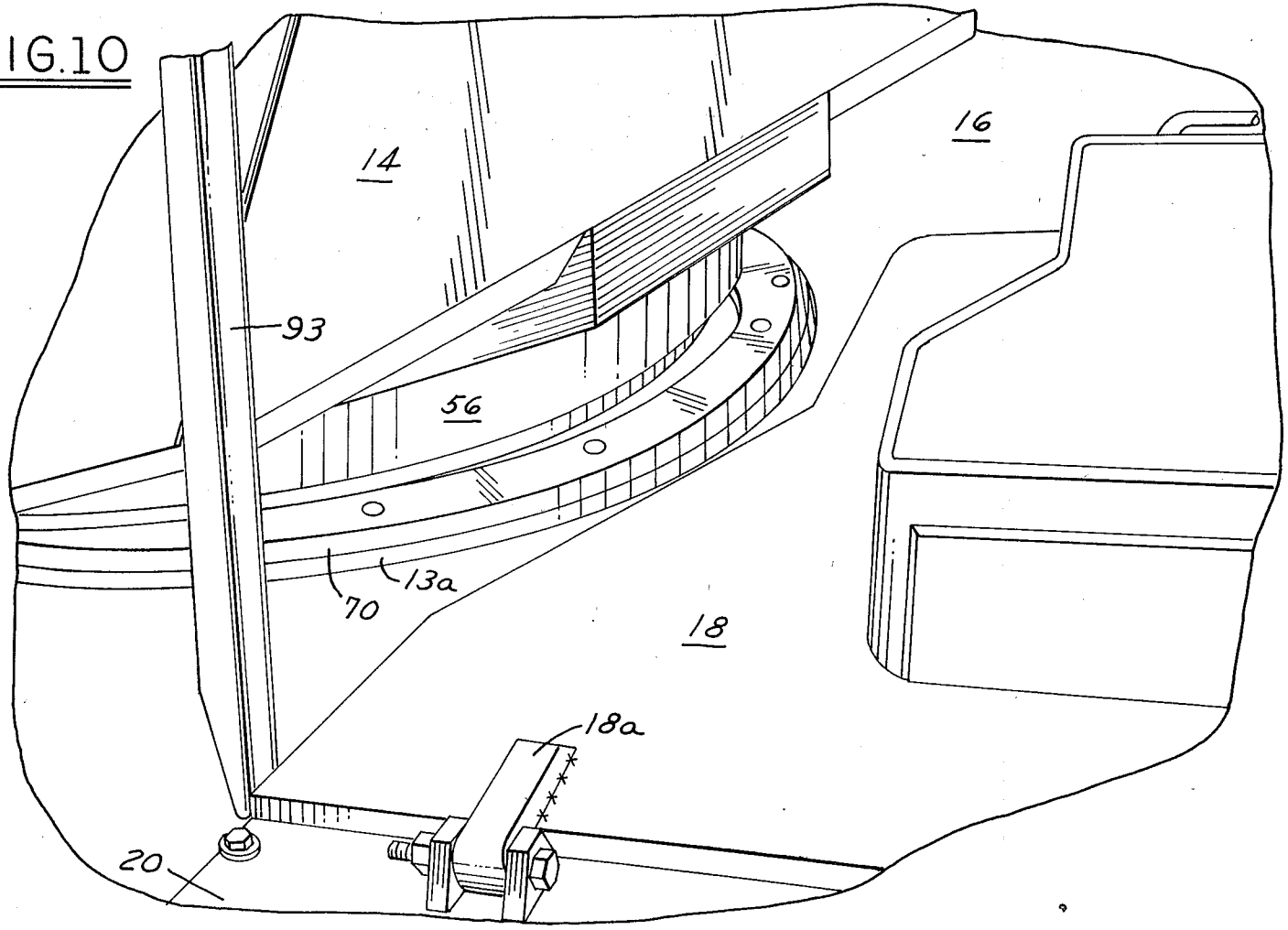
FIG. 10 is a partial perspective of the turret body and exhaust plenum hatch showing a pry bar positioned therebetween to pivot the turret.

Typically, the turret 12 is first rotated so that the weapons 22 and 24 face rearwardly with a turret portion 12*a*′ overhanging the exhaust plenum hatch 18, FIG. 9. Then, the bolts 64 and nuts 66 are removed to release the turret from the releasable fixed mounting on the vehicle with only slight loosening of the pivot bolt 64′ and associated nut 66′ however. The slip ring 104 is also disconnected by removing four bolts that hold it to the cage floor 90. Then, a pry bar 93 or the like is positioned between the turret body 14 and the exhaust hatch 18, FIG. 10, and the turret is pivoted clockwise to the outboard position illustrated in FIGS. 11 and 12. The exhaust hatch 18 can then be swung open about hinges 18*a*.

Once the maintenance or other work inside the engine compartment or vehicle is completed, the turret is pivoted back to its original position, e.g., by pulling a rope or chain engaged to the eyelet 110 in the opposite direction (counterclockwise), and bolts 64 and nuts 66 reconnected to again mount the turret on the spacer member 70 and rim 13*a* of the vehicle. Maintenance of the vehicle under field conditions is thus significantly facilitated.

FIGS. 7 and 8 illustrate the different positions of the operator's cage 30, in particular cage floor 90, during the turret pivoting procedure. For example, FIG. 7 shows the position of the cage floor 90 when the turret is rotated so that the weapons 22, 24 face rearwardly (FIG. 9). It is apparent that the truncated portions 90*b*, 90*c* of the cage floor are spaced from outboard vertical wall 13*b* of the vehicle body with the support tubes 82, 84, 86 of the cage remote from the outboard wall 13*b* toward the interior of the vehicle. When the turret is eccentrically pivoted clockwise about bolt 64′ located at the top of FIG. 7, the cage will move eccentrically to the position shown in FIG. 8 and also FIG. 6 wherein the truncated portion 90*b* is parallel with the outboard body wall 13*b* and truncated portion 90*c* spaced from bracket 120 on the wall 13*b*. By using an operator's cage configured in the above-described manner, the amount of turret pivoting (approximately 25°) can be accommodated.

While certain specific and preferred embodiments of the invention have been described in detail hereinabove, those skilled in the art will recognize that various modifications and changes can be made therein within the scope of the appended claims which are intended to include equivalents of such embodiments.

I claim:

1. An armored vehicle having a body with an access hatch means openable to the vehicle interior and a turret rotatable and eccentrically pivotable on the vehicle, said turret including an annular turret support means in an operative position on the vehicle body for releasably mounting the turret support means on the vehicle body in said operative position, a turret body, means for rotatably mounting the turret body on the turret support means for rotation about a first axis, and means for pivotably mounting the turret support means on the vehicle body for eccentric movement relative to said first axis when the turret support means is released from its operative position, whereby the turret can be pivoted laterally away from the access hatch means without being removed from the vehicle body, and operator cage means in the vehicle body attached to the turret body for rotational and eccentric movement therewith, said cage means including floor means with a circular arc portion and truncated straight portion and support means attached to the floor means at one end to the circular arc portion and at the other end to the turret body to permit eccentric movement of the cage means in the vehicle body.

2. The vehicle of claim 1 wherein the means rotatably mounting the turrent support means comprises bearing means between the turret body and turret support means.

3. The vehicle of claim 1 wherein the means releasably mounting the turret support means comprises a plurality of releasable connector means, one of which functions as the pivotable mounting means for the turret support means when the others are released.

4. An armored vehicle having a top surface with an opening and an access hatch means adjacent the opening, a turret on the top surface with portions of the turret overlying the access hatch means preventing opening thereof, annular turret support means on the top surface between the turret and top surface, annular bearing means between and operatively connected to the turret and turret support means for rotatably mounting the turret on the turret support means, and a plurality of connector means for releasably fastening the turrent support means to the top surface with one of said connector means functioning as pivot means when the others are released for allowing eccentric pivoting of the turret support means and turret thereon relative to the rotational axis out of overlying relation to the access hatch means to allow opening thereof.

5. The vehicle of claim 4 which further includes operator cage means in the vehicle attached to the turret means for rotation therewith and configured such that the cage means can pivot eccentrically inside the vehicle when the turret means is pivoted.

6. The vehicle of claim 4 wherein the releasable connectors are threaded bolt means and one of said bolt means is adapted to function as a pivot for the turret means.

7. An armored vehicle having a top surface with an opening and a rotational axis through said opening and with an access hatch means adjacent the opening, a turret overlying the opening in the top surface with portions of the turret overlying the access hatch means preventing opening thereof, annular turret support means on the top surface coaxially aligned with the rotational axis, annular bearing means between and operatively connected to the turret and turret support means and coaxially aligned with the rotational axis for rotatably mounting the turret on the turret support means about the rotational axis, and a plurality of connector means for releasably fastening the turret support means to the top surface with one of said connector means functioning as pivot means when the others are released for allowing eccentric pivoting of the turret support means and turret about said pivot means relative to said rotational axis out of overlying relation to the access hatch means to allow opening thereof.

8. An armored vehicle having a top surface with an opening and an access hatch means adjacent the opening, an annular turret support means on the top surface, a turret overlying the opening with portions of the turret overlying the access hatch preventing its opening, annular bearing means between the turret support means and turret including an annular race affixed to the turret support means, another annular race affixed to the turret and bearings between the races for rotatably mounting the turret on the turret support means, and a plurality of connector means in annular array and extending through the turret support for releasably fastening the turret support means to the top surface with one of said connector means functioning as pivot means when the others are released for allowing eccentric pivoting of the turret support means and turret thereon about said pivot means out of overlying relation to the access hatch means to allow opening thereof.

9. A method for exposing access hatch match means on an armored vehicle having a turret with portions at least partially overlying the access hatch means preventing opening thereof, comprising rotatably mounting the turret on a turret support means with the portions of the turret at least partially overlying the access hatch means, releasably mounting the turret support means on the vehicle adjacent the access hatch means using a plurality of releasably connector means, releasing the connector means while having one of said connector means function as a pivot means for the turret support means, and eccentrically pivoting the released turret support means with turret thereon about the pivot means laterally out of the way of access hatch means to allow opening thereof.

* * * * *